US008046940B2

(12) United States Patent
Jones et al.

(10) Patent No.: US 8,046,940 B2
(45) Date of Patent: Nov. 1, 2011

(54) FOLDER WITH CARD-RECEIVING RECESS

(75) Inventors: Braden Jones, Phoenix, AZ (US); Juliet Kenney, New York, NY (US); Lauren Grassia, East Northport, NY (US)

(73) Assignee: Esselte Corporation, Melville, NY (US)

( * ) Notice: Subject to any disclaimer, the term of this patent is extended or adjusted under 35 U.S.C. 154(b) by 0 days.

(21) Appl. No.: 12/121,702

(22) Filed: May 15, 2008

(65) Prior Publication Data

US 2009/0282714 A1 Nov. 19, 2009

(51) Int. Cl.

| | |
|---|---|
| ***G09F 1/10*** | (2006.01) |
| ***B42F 21/00*** | (2006.01) |
| ***B65D 27/00*** | (2006.01) |
| ***B65D 27/04*** | (2006.01) |
| ***B65D 27/08*** | (2006.01) |
| ***B42D 1/00*** | (2006.01) |

(52) U.S. Cl. ..... 40/124; 40/359; 281/29; 281/38; 229/67.1; 229/92.8; 229/71; 229/72; 402/73

(58) Field of Classification Search ..... 40/359, 40/124; 281/29, 38; 229/67.1, 92.8, 71, 229/72; 402/73

See application file for complete search history.

(56) References Cited

U.S. PATENT DOCUMENTS

| | | | | |
|---|---|---|---|---|
| 4,636,179 | A | 1/1987 | Gentile et al. | 402/79 |
| 4,713,901 | A | 12/1987 | Wells et al. | 40/360 |
| 5,349,769 | A | 9/1994 | Okola | 40/124.1 |
| 5,882,038 | A | 3/1999 | Ong | 281/31 |
| 6,108,953 | A * | 8/2000 | Hall | 40/359 |
| 6,213,519 | B1 | 4/2001 | Bosch | 283/81 |
| 6,244,627 | B1 * | 6/2001 | Wolff et al. | 281/29 |
| 6,698,116 | B2 * | 3/2004 | Waldron | 40/124.11 |
| 6,991,839 | B2 | 1/2006 | Maier | 428/40.1 |
| 2003/0025317 | A1 | 2/2003 | Yamamoto et al. | 281/31 |

FOREIGN PATENT DOCUMENTS

GB 2 222 986 A 3/1990

* cited by examiner

*Primary Examiner* — Joanne Silbermann
*Assistant Examiner* — Syed A Islam
(74) *Attorney, Agent, or Firm* — Dorsey & Whitney LLP

(57) ABSTRACT

A file with a card-receiving recess is disclosed. The file comprises a first panel comprising a first layer and a backing layer, that contains an opening extending from the first layer to the backing layer, and a second panel hingedly associated with the first panel. The backing layer is configured to support a displayed sheet element in a position such that it is visible through the opening of the first layer, and the displayed sheet element is at least partially received within the thickness of the first surface and the backing layer. The backing layer contains an adhesive disposed thereon within the opening for securing the displayed sheet element to the backing.

30 Claims, 6 Drawing Sheets

FOLDER WITH CARD-RECEIVING RECESS

FIELD OF INVENTION

The present invention relates to a file configured for receiving and displaying a display sheet. More particularly, the invention relates to a file having an opening for displaying the display element therein such that the display element can be mounted.

BACKGROUND OF THE INVENTION

It is known to provide file folders for adhesively attaching business cards. For example, U.S. Pat. No. 6,108,953 discloses a file folder business card organizer wherein the business card is attached to the tab portion of a file folder by means of an adhesive. Alternatively, the business card can be attached to the folder by inserting the corners of the business card into diagonal slits located diagonally opposite each other.

Also, U.S. Pat. No. 4,930,928 discloses an index card for use in conjunction with a rotary card file or the like, which includes a means for displaying a business card through the use of slots, flaps or adhesives to secure the business card to the index card. U.S. Pat. No. 4,713,901 discloses a file-index card system for retaining and displaying business cards, which includes a frame in which multiple file cards in the form of planar sheets are held. Each file card has an area of adhesive covering a portion thereof, with a protective peel-off covering placed over the area of adhesive.

There is a need for a simple, inexpensive folder which can display a card with an improved presentation.

SUMMARY OF THE INVENTION

The present invention relates to a folder with a display area for displaying a sheet element. The preferred embodiment has a first panel and a second panel, and the second panel is hinged to the first panel. The first panel has an outer layer which has a first surface and a second surface, and a thickness therebetween. The outer layer preferably defines an opening extending from the first surface to the second surface and configured and dimensioned for receiving and displaying a displayed sheet element inserted therein. A backing layer is affixed to the outer layer behind the opening adjacent to the second surface and configured to support the displayed sheet element in a display position visible through the opening, such that the displayed sheet element in the display position is at least partially received between the first surface and the backing layer. The backing layer has an adhesive disposed within the opening for securing the displayed sheet element to the backing layer in the display position.

Preferably, the second panel of the file is hinged to the first panel such that the second panel is overlaid on the first panel when the file is in a closed position. More preferably, the file comprises a folder.

In a preferred embodiment, the outer and backing layers are configured and associated such that the displayed sheet element is received in the opening within the thickness of the outer layer. More preferably, the first and backing layers are configured and associated such that the displayed sheet element is substantially flush with the front panel when in the display position. In another embodiment, the first and backing layers may be configured and associated such that the displayed sheet element is substantially flush with the first surface of the first layer when in the display position. In yet another embodiment, the opening extends to an edge of the first layer such that an edge of the displayed sheet element is laterally exposed when the displayed sheet element is in the display position.

Preferably, the file is a portfolio, and the displayed sheet element is a business card. Preferably, the opening is configured to correspond closely to the dimensions of the business card, such that the business card is completely visible through the opening, when the business card is in the display position. The opening is preferably configured to receive the business card from the outside towards the backing layer to adhere the business card to the backing layer of the file when in the display position.

In a preferred embodiment, the file opening extends to at least one edge of the first panel. More preferably, the file includes a hinge that joins the first and seconds panels and the opening extends only to the side edge of the first panel opposite the hinge. The file contains a protective strip that is removably disposed on the adhesive for protecting the adhesive prior to attaching the displayed sheet element. Preferably, the first layer is the outer layer of the first panel of the file, and is visible from the outside of the file the first panel overlaid with the second panel.

The inventive file can thus provide an improved presentation of a business card or other displayed sheet element.

BRIEF DESCRIPTION OF THE DRAWINGS

The invention will be better understood with reference to the attached drawings illustrating preferred embodiments, wherein.

DETAILED DESCRIPTION OF THE PREFERRED EMBODIMENTS

Figure 1:
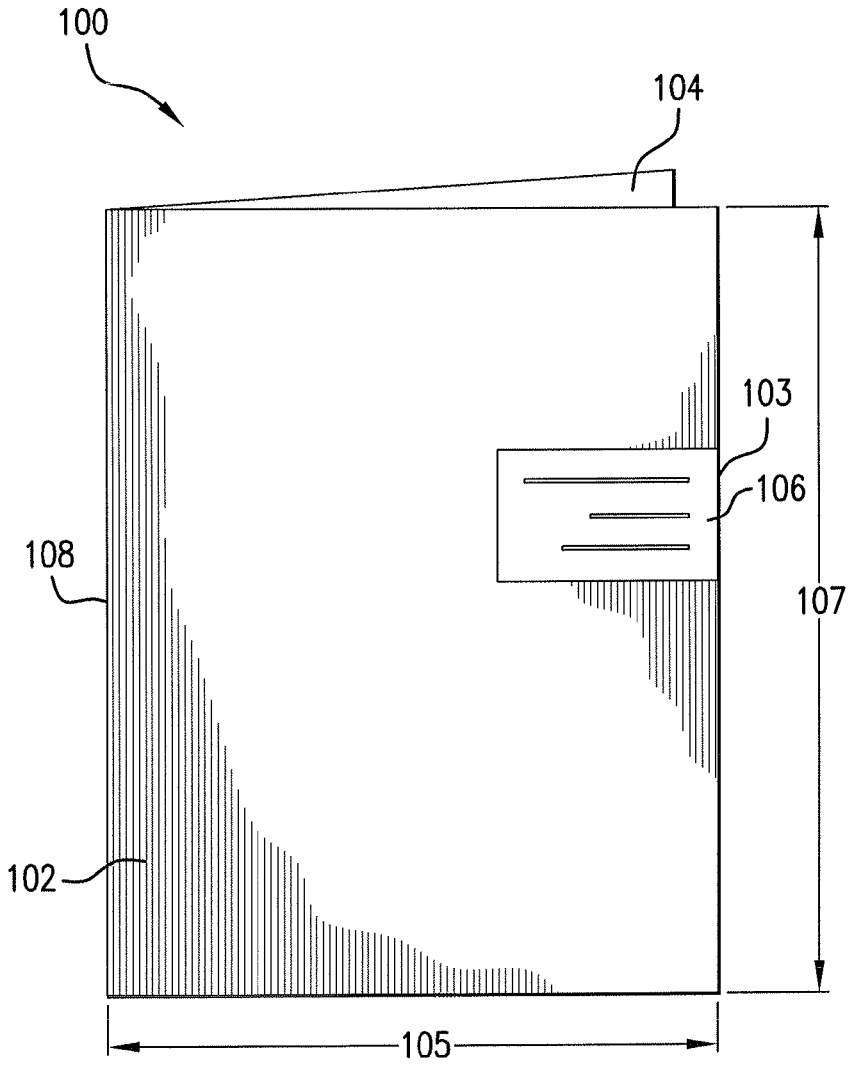
FIG. 1 is a perspective front view of a folder and backing layer constructed in accordance with an embodiment of the present invention.

Referring to FIG. 1, a file 100 having a front panel 102, a back panel 104, and a displayed sheet element 106 is shown. The front panel 102 has four edges, namely the top edge, the bottom edge, the side edge, and the hinged edge. The back panel 104 also has four edges, namely the top edge, the bottom edge, the side edge, and the hinged edge. The distance between the hinged edge and the side edge is herein defined as the width 105. The distance between the top edge and the bottom edge is herein defined as the height 107. The back panel 104 also has four edges, namely the top edge, the bottom edge, the side edge, and the hinged edge.

Figure 6:
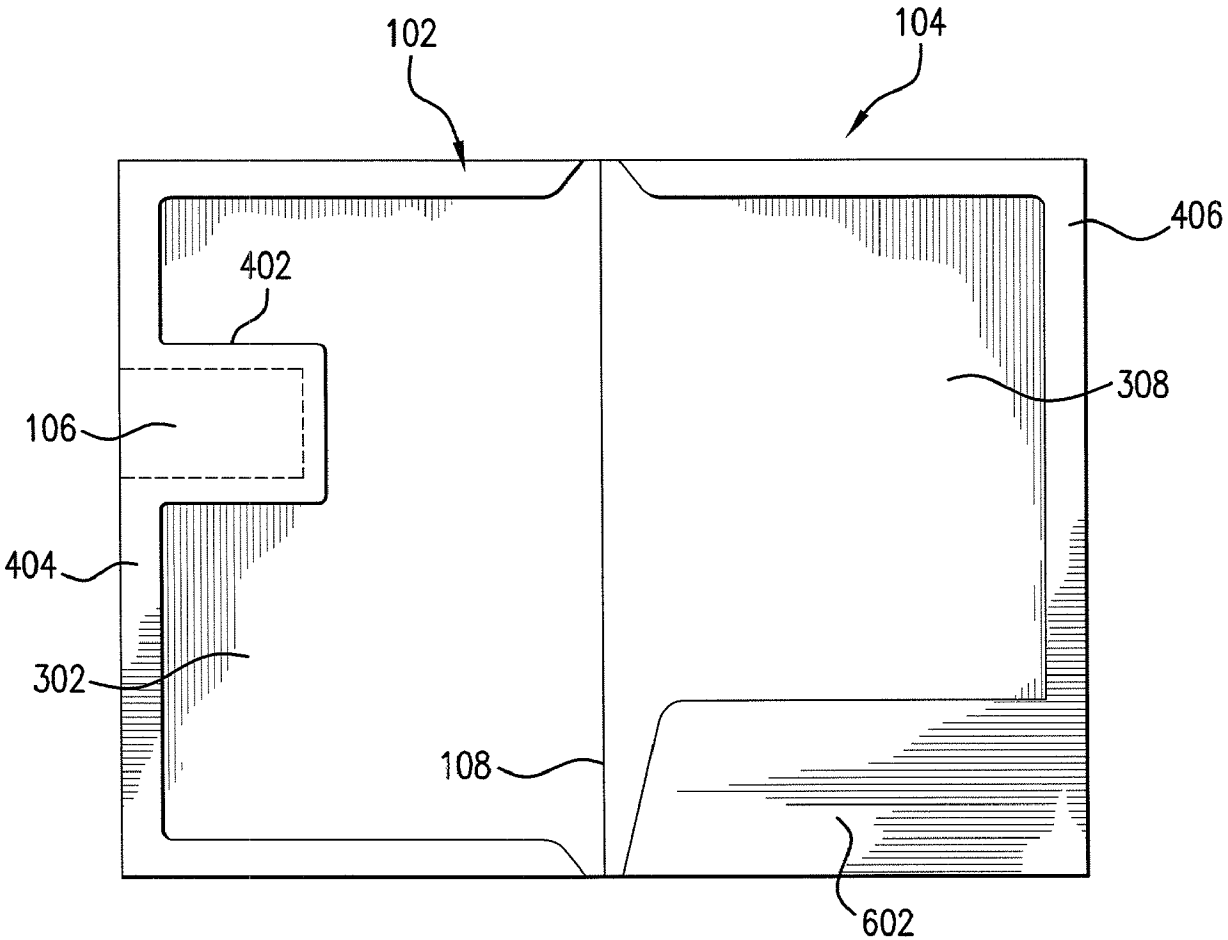
FIG. 6 is an interior view of the folder of FIG. 4 in an open position.

Front panel 102 and back panel 104 are hingedly associated, for example, along the fold line 108 for pivotal movement between a closed file position, and an open file position wherein the front panel 102 extends at an angle from the back panel 104, as shown in FIGS. 1 and 6. The front and back panels may be hinged together using any suitable method including welding and heat sealing. The file 100 can be of any suitable size, color, shape and texture, and is preferably made of a material that is sufficiently rigid to resist bending and sufficiently resilient to withstand handling by the user. Preferred materials include plastic (e.g. thermoplastic such as polypropylene and PVC), paper (e.g. paperboard), cardboard and metal. The preferred file is a portfolio, but can have other constructions, such as a binder, notebook, file pocket, folding card, and accordion file. For example, the file 100 can be of conventional portfolio or file folder size and can be formed from a single one or more blanks, for example including a blank that can be of substantially rectangular paperboard material that is folded along a fold line 108 to hingedly define panels 102 and 104, such that the panels 102 and 104 are interconnected to each other along the fold line 108. The file can also have more than two cover panels.

The folder 100 is preferably configured to contain papers of standard sizes to be used in an office environment, such as letter, legal, A3 or A4. More preferably, the folder 100 is a portfolio. A portfolio can include a case for carrying papers, drawings, photographs, maps and other flat documents. Preferably, the file has a width of between 5.0 inches and 14.0 inches, and a height of between 6.0 inches and 17.0 inches. In one embodiment, the file is a portfolio having a width of 9.5 inches and a height of 11.5 inches.

The displayed sheet element 106 can be of any suitable shape and size, and in a preferred embodiment, the displayed sheet element 106 is a business card as commonly used to provide one's business or personal information. Such information can typically include an individual's name, company affiliation and logo, and contact information often including a street address, telephone and facsimile numbers, email addresses, and websites. The business card can be made from any suitable material including paper, cardboard, plastic, metal, cloth, and magnetic sheet material. Typical business card dimensions are a width of around 3.5 inches and a height of around 2 inches. Typical business card sizes are a width of between about 2.5 inches to about 4 inches, and a height of between about 1.5 inches to about 3.0 inches. In other embodiments, differently shaped and sized displayed sheet elements are employed.

Figure 2:
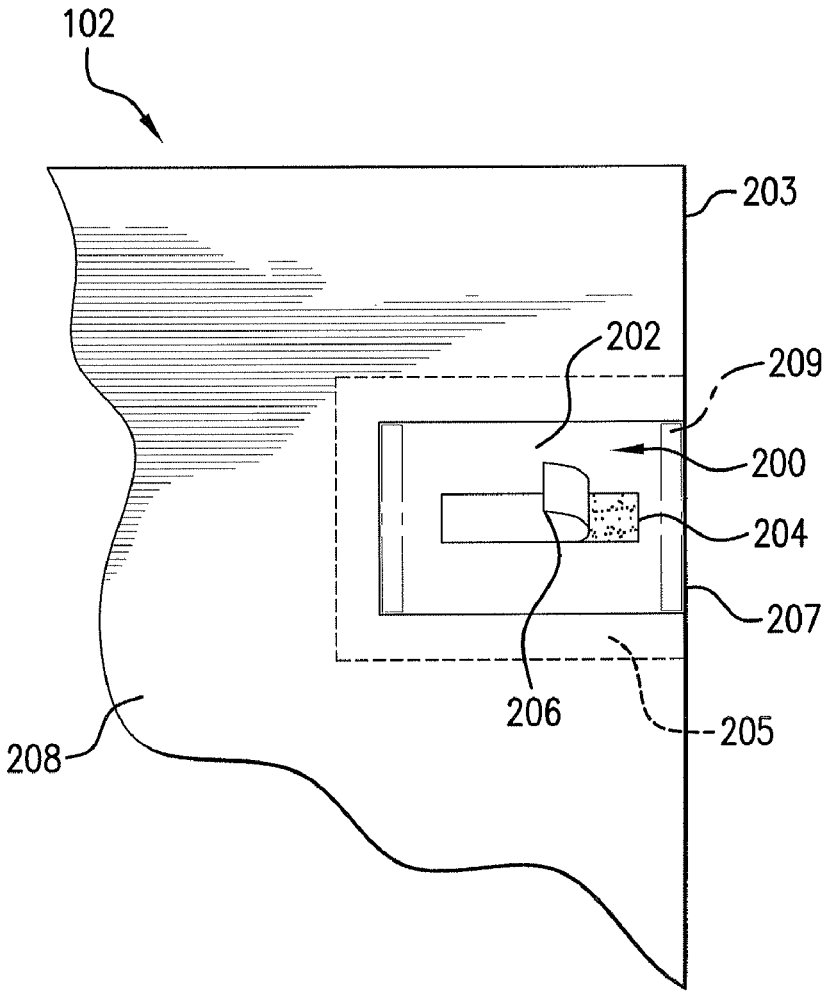
FIG. 2 is a partial view of the cover thereof ready to attach a card.

Referring to FIG. 2, the front panel 102 includes a plurality of layers that can be made of separate sheets, or that can be made by folding over a sheet. A first layer, preferably an outer layer 208, defines an opening 200 extending therethrough, which exposes a portion of a backing layer 202 of the front panel 102. In the embodiment shown, the opening 200 extends to at least one edge of the outer layer 208, preferably to the lateral edge 203 of the front panel 102 and more preferably to the lateral edge that is opposite the hinge 108, such that at least one edge 203 at the outer layer is interrupted by the opening 200. With this configuration, the lateral edge 103 of the displayed sheet element 106 is exposed from the side of the front panel 102. The backing layer 202 is preferably affixed to the outer layer behind the opening, most preferably so that the lateral edge 207 of the backing layer is near or is substantially a continuation and aligned with the lateral edge 203 of the outer layer 208.

In another embodiment, the adhesive is provided near the edges of the opening. As shown in phantom lines in FIG. 2, the adhesive can be provided in areas 209 which are disposed at the lateral side of the opening. Alternatively or additionally, the adhesive can be provided at the top and bottom edges of the opening. Also, in these embodiments it is preferable to dispose the adhesive such that it extends to adjacent boundaries of the opening on the backing layer, and it is preferable that the adhesive be disposed near the corners of the opening. Positioning the adhesive near the corners or other edges of the opening helps make the transition between the displayed sheet element and the outer layer more continuous, since it can prevent the edges of the displayed sheet element from lifting out of the opening. It can also be suitable to completely cover the opening with an adhesive to retain the displayed sheet element.

The backing layer 202 is preferably affixed with an adhesive disposed in the area of overlap 205, or by another suitable means such as plastic welding or heat sealing if the folder is made of plastic between the backing layer 202 and the outer layer 208, preferably surrounding the opening 200, so that there is preferably no movement between the backing layer 202 and the outer layer 208 at the opening 200.

An adhesive 204 is disposed on the front side of the backing layer 202, within the opening 200, for affixing a displayed sheet element 106 thereto. The adhesive 204 preferably includes a peel-off protective layer or strip 206, or other protective coating or cover as known in the art, to protect the adhesive 204 prior to use. When the protective peel-off layer 206 is removed, a suitable displayed sheet element, such as a business card, can be affixed in a display position to the backing layer 202, as shown in FIG. 1. The adhesive 204 can include any suitable adhesive including glue and adhesive tape. In an alternative embodiment, the adhesive is selected to permit removal and replacement of the displayed sheet element 106, but the adhesive is non-reusable in the preferred embodiment and configured to securely and preferably permanently retain the displayed sheet element. Types of adhesives include repositionable, removable, permanent, remoistenable, hot melt, pressure seal (cohesive), cold glue, and combinations thereof. The adhesive can be provided in the form of transfer tapes, pressure sensitive tapes and the like, which usually will have a removable protective cover thereon.

The displayed sheet element 106 is preferably loaded by inserting it directly into the opening 200 from the front side of the front panel 102. Where the dimensions of the displayed sheet element 106 are predetermined, such as when it is a business card, the dimensions and shape of the opening 200 can be selected to closely correspond with those of the displayed sheet element 106. Most preferably, the opening is less than about 1/16 inches larger in height and in width than the displayed sheet element 106, and can be within less than 1 mm or ½ mm to provide a more flush appearance without large gaps. The displayed sheet element 106 in the embodiment shown is receivable from the front of the opening 200 and affixable to the backing layer 202 to substantially prevent any relative movement along the cover therebetween such that the displayed sheet element 106 is visible through the opening when the displayed sheet element 106 is in the display position.

In a preferred embodiment, at least two edges 103 of the displayed sheet element 106 are visible through the opening when the displayed sheet element is mounted to the folder in the display position. More preferably, at least three edges of the displayed sheet element 106 are visible through the opening when the displayed sheet element is in the display position. Most preferably, all of the edges of the displayed sheet element 106 are visible through the opening when the displayed sheet element is in the display position.

In the preferred embodiment, the opening 200 is configured and dimensioned such that when the displayed sheet element 106 is adhesively secured to the backing layer 202 in the display position, the displayed sheet element is completely visible through the opening 200. In other embodiments, the opening 200 may be configured and dimensioned such that when the displayed sheet element 106 is secured to the backing layer 202 in the display position, the displayed sheet element 106 is partially obstructed, such as by an extension of the outer layer, although preferably all corners and/or sides of the display element are exposed.

Figure 3:
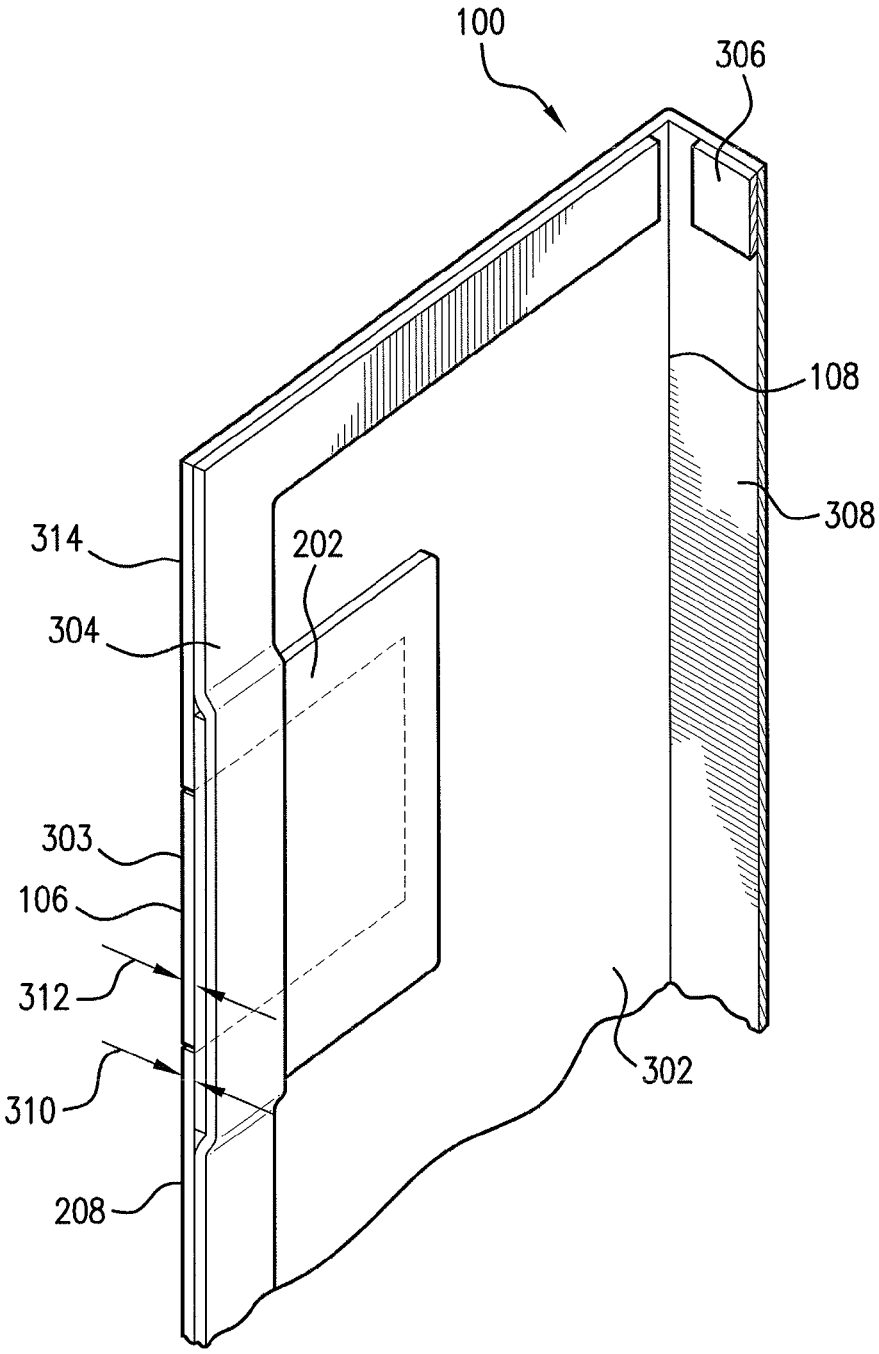
FIG. 3 is a perspective view of the interior of the front cover thereof.

Referring to FIG. 3, the outer layer 208 has a thickness 310, extending from the outer surface 314 to the inner surface 302 thereof. The various layers of the folder 100 are preferably formed of a single sheet of material, although alternatively they can be made with various sublayers or sheets, for example all cooperatively defining the opening 200. The thickness 310 corresponds to thicknesses of material that would typically be used in making a file, for example, paper, plastic and cardboard. A faux fold is provided in the embodiment of FIG. 3 by securing, preferably with an adhesive or plastic welding or other suitable means, an inner layer 304 to inner surface 302 of the outer layer, such as over the interior of the top, side, and/or bottom edge portions of the second surface 302 of the outer layer. Alternatively or additionally, another fold or partial or complete layer can be applied to the outside of the outer layer. A folded portion or other layers can additionally be applied to other parts of the cover layers, such as along the top, side, and bottom edge portions of the back panel 104, or adjacent the hinge 108 or another portion of the covers.

The backing layer 202 is preferably dimensioned such that is closes off the entire opening 200. In other embodiments, the backing layer can cover less than the entire opening, but be sufficiently large to adequately support a displayed sheet element 106 adhered thereto. Preferably, the backing layer is at least around 0.25 inches larger than the opening to provide sufficient area to adhere to the outer layer 208.

While in the embodiment of FIG. 3, the layer 304 providing the faux edge is adhered over the backing layer 202, it can alternatively be provided between the backing layer 202 and the outer layer 208. Additionally, an intermediary layer can be provided around the periphery of the opening 200, between the outer layer 208 and the backing layer 202 to increase the depth of the space within the opening to receive the displayed sheet element 106.

Most preferably, the thickness of the outer layer 208 and any intermediary layer is selected to generally match the thickness 312 of the displayed sheet element 106 and any adhesive, to provide a thickness 310 (or a thickness combined with intermediary layers and optionally with layers disposed on the outside of the outer layer 208 around the opening 200) so that the outer surface 303 of displayed sheet element 106 in the display position is generally flush with the outer surface of the front panel 102 or outer layer.

In an alternative embodiment, the thickness 312 of the displayed sheet element is less than thickness 310, and the displayed sheet element 106 is disposed behind the outer surface 314 of the front panel 102 so that it is recessed within the opening. In yet another embodiment, the thickness 312 of the displayed portion 106 is greater than that of the outer layer and the outer surface 303 of the displayed sheet element 106 remains proud of the outer surface 314 of the front panel 102.

Figure 4:
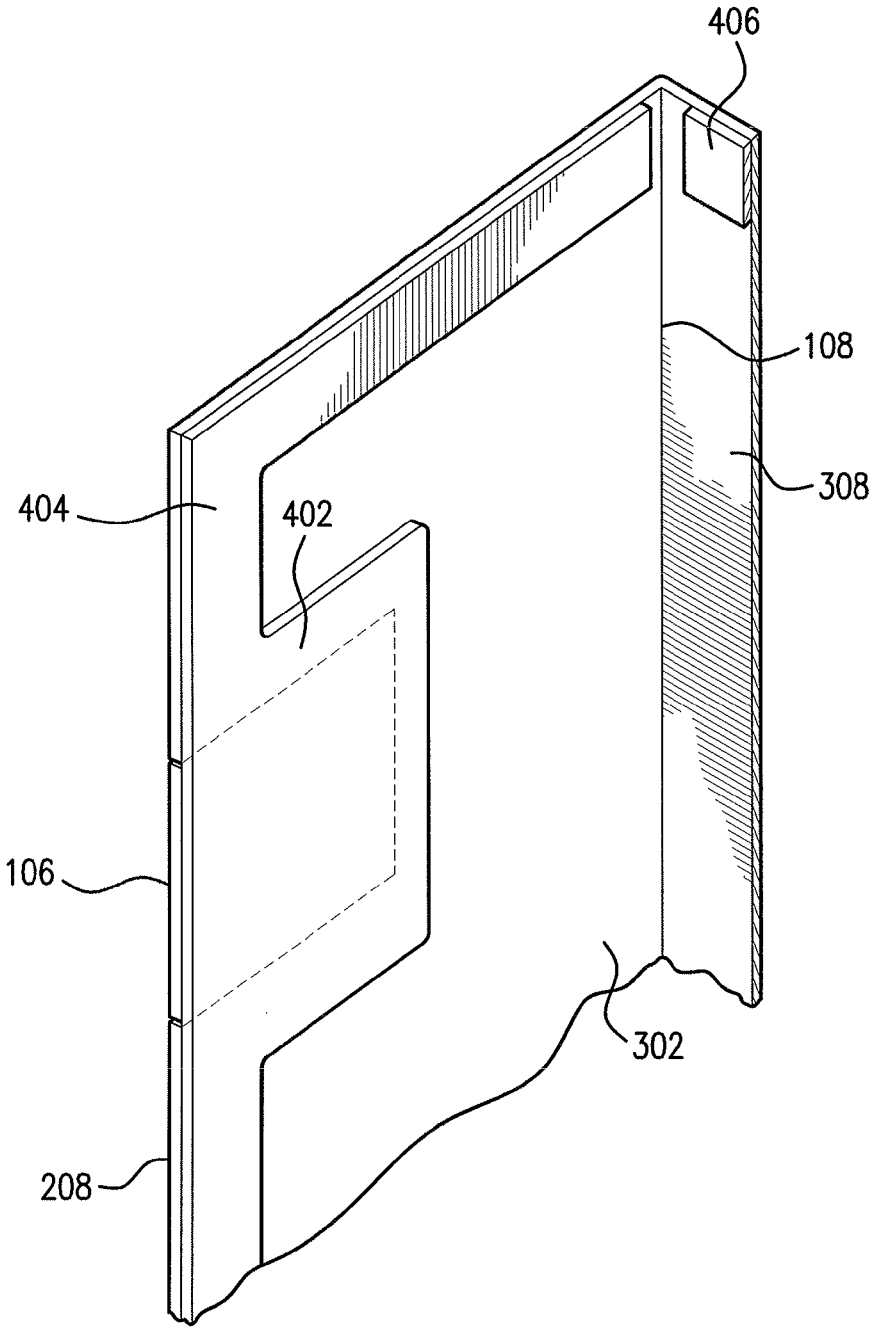
FIGS. 4 and 5 are perspective views of the interior of the front covers of alternative embodiments of a folder constructed in accordance with the invention.
Figure 5:
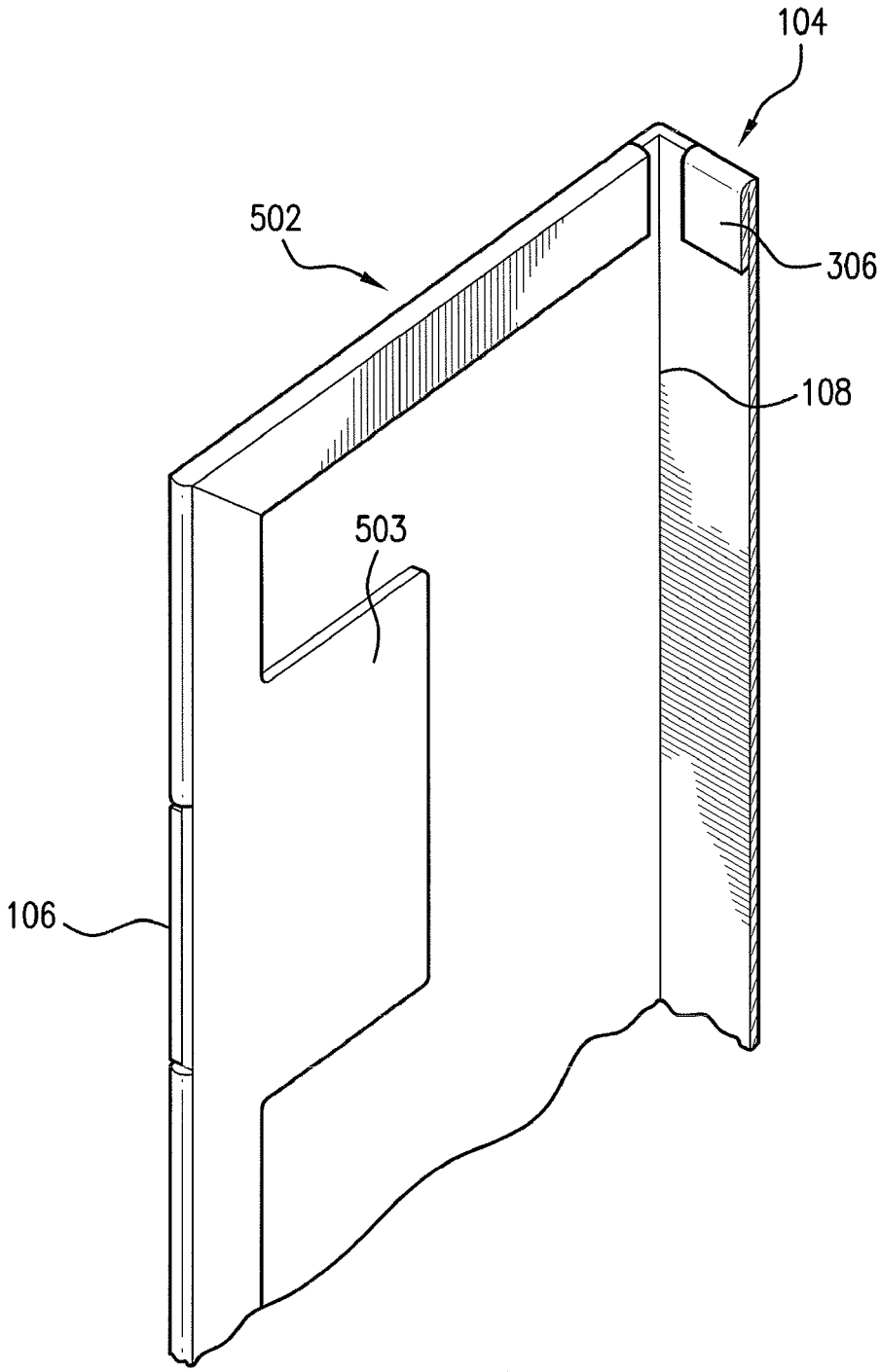

FIG. 4 shows an embodiment in which the faux fold and edge stiffening layer 404 is of unitary with the backing layer 402, such by cutting them from a same blank. The embodiment of FIG. 5 has an outer layer 502 and backing layer 503 of unitary construction, being provided, for example, by folding over the portions of a unitary blank.

Referring to FIG. 6, layer 406 is affixed to the top edge, side edge and bottom edge of the second surface 308 of the outer layer of the back panel 104, and preferably includes a pocket 602 that is not affixed except at the bottom and right edges thereof to receive sheets as known in the art. The pocket 602 is preferably adhered at or near the bottom and side edge of second surface 308 of back panel 104. Preferably, the pocket is configured and dimensioned for holding and retaining papers of at least letter, legal, A3, or A4 size in the holding location. In some embodiments, a binding mechanism or support can be included and can be disposed, for instance, near the hinge 108.

As used herein, the term "about" should generally be understood to refer to both the corresponding number and a range of numbers. In addition, all numerical ranges herein should be understood to include each whole integer within the range. While illustrative embodiments of the invention are disclosed herein, it will be appreciated that numerous modifications and other embodiments may be devised by those skilled in the art. For example, the features for the various embodiments can be used in other embodiments and the opening for the displayed sheet can be provided in the back cover or another cover of a folder. Therefore, it will be understood that the appended claims are intended to cover all such modifications and embodiments that come within the spirit and scope of the present invention.

What is claimed is:

1. A file, comprising:

a first panel, which comprises:

a first layer having first and second surfaces and a thickness therebetween, the first layer defining an opening having sides and extending from the first surface to the second surface and configured and dimensioned for receiving and displaying a displayed sheet element inserted therein, a second layer disposed behind the opening and behind the first layer in an area of overlap that surrounds and is adjacent to a group of the opening sides, the second layer being configured to support the displayed sheet element in a display position visible through the opening, wherein the displayed sheet element in the display position is received at least partially between the first surface and the second layer, wherein the first and second layers are affixed to each other in all portions of the area of overlap that are adjacent the opening sides, and an adhesive disposed on the second layer within the opening for securing the displayed sheet element to the second layer in the display position, and a second panel connected to and overlaid with the first panel.

2. The file of claim 1, wherein the second panel is hinged to the first panel such that in a closed position the second panel is overlaid on the first panel.

3. The file of claim 1, wherein the file comprises a folder.

4. The file of claim 1, wherein the first and second layers are configured and associated such that the displayed sheet element in the display position is received in the opening within the thickness of the first layer.

5. The file of claim 4, wherein the first and second layers are configured and associated such that the displayed sheet element in the display position is substantially flush with the front panel.

6. The file of claim 4, wherein the first and second layers are configured and associated such that the displayed sheet element in the display position is substantially flush with the first surface of the first layer.

7. The file of claim 4, wherein the opening extends to an edge of the first layer such that an edge of the displayed sheet element is laterally exposed when in the display position.

8. The file of claim 1, wherein the file is a portfolio.

9. The file of claim 1, wherein the displayed sheet element is a business card.

10. The file of claim 9, wherein the opening is configured to closely correspond to the dimensions of the business card, such that when the business card is in the display position, the business card is completely visible through the opening and is disposed substantially completely within a boundary of the first panel.

11. The file of claim 10, wherein the opening is configured to receive the business card inserted from the outside towards the second layer.

12. The file of claim 9, further comprising the business card adhered to the second layer in the display position.

13. The file of claim 1, wherein the opening extends to at least one edge of the first panel.

14. The file of claim 13, further comprising a hinge that pivotally associates the first and second panels, wherein the opening extends to only a side edge of the first panel opposite the hinge.

15. The file of claim 1, further comprising a protective strip removably disposed on the adhesive for protecting the adhesive prior to attaching the displayed sheet element.

16. The file of claim 1, wherein the first layer is an outer layer of the first panel that is visible from the outside of the file with the first panel overlaid with the second panel, wherein the outer layer faces in a direction away from the second panel when the first panel is overlaid with the second panel.

17. The file of claim 16, wherein the first panel is an outer panel of the file.

18. The file of claim 1, said group of opening sides includes at least three edges of the opening.

19. The file of claim 18, wherein the second layer is affixed to the first layer so that the second layer is fixed relative to the first layer.

20. The file of claim 18, wherein the second layer has a surface area that is significantly less than a surface area of the first layer.

21. A file, comprising:

a first panel, which comprises:

a first layer having first and second surfaces and a thickness therebetween, the first layer defining an opening having sides and extending from the first surface to the second surface and configured and dimensioned for receiving and displaying a displayed sheet element inserted therein, a second layer having a surface area substantially less than a surface area of the first layer and disposed behind the opening and behind the first layer in an area of overlap that surrounds and is adjacent to a group of the opening sides, the second layer being configured to support the displayed sheet element in a display position visible through the opening, wherein the displayed sheet element in the display position is received at least partially between the first surface and the second layer, wherein the first and second layers are affixed to each other in substantially all portions of the area of overlap that are adjacent the opening sides, and an adhesive disposed on the second layer within the opening for securing the displayed sheet element to the second layer in the display position, and a second panel connected to and overlaid with the first panel.

22. The file of claim 21, wherein the second layer includes a portion that extends from a lateral edge of the first layer to an area adjacent to an edge of the opening that is opposite the lateral edge of the first layer.

23. The file of claim 22, wherein a length of the portion of the second layer from the lateral edge of the first layer to the area adjacent to the edge of the opening that is opposite the lateral edge of the first layer is less than approximately half a width of the file defined as a length from the lateral edge of the first layer to a hinge that pivotally associates the first and second panels.

24. The file of claim 1, wherein the first and second layers are affixed to each other in the area of overlap adjacent to all of said selected opening sides such that movement between the first and second layers at said plurality of opening sides is substantially prevented.

25. The file of claim 1, wherein the first and second layers are affixed along substantially the entire area of overlap.

26. The file of claim 1, wherein the first panel further comprises an intermediate layer affixed to the first and second layers in the area of overlap adjacent to said plurality of opening sides.

27. The file of claim 10, wherein the opening is configured to be slightly larger than a business card.

28. The file of claim 10, wherein the opening has business card dimensions.

29. The file of claim 10, wherein the opening is approximately 3 ½ inches by 2 inches.

30. The file of claim 10, wherein the opening is within about 1/16 of an inch greater than, and no smaller than 3 ½ inches by 2 inches.

* * * * *